US011270652B2

(12) United States Patent
Lee

(10) Patent No.: US 11,270,652 B2
(45) Date of Patent: Mar. 8, 2022

(54) DISPLAY DEVICE, DATA DRIVING CIRCUIT, AND DATA DRIVING METHOD HAVING OFFSET DATA VOLTAGE

(71) Applicant: LG Display Co., Ltd., Seoul (KR)

(72) Inventor: Wonsuk Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/115,652

(22) Filed: Dec. 8, 2020

(65) Prior Publication Data

US 2021/0183320 A1 Jun. 17, 2021

(30) Foreign Application Priority Data

Dec. 16, 2019 (KR) ..... 10-2019-0167406

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2310/027* (2013.01); *G09G 2310/0291* (2013.01); *G09G 2310/08* (2013.01); *G09G 2320/0252* (2013.01); *G09G 2330/021* (2013.01)

(58) Field of Classification Search
None
See application file for complete search history.

(56) References Cited

U.S. PATENT DOCUMENTS

2006/0221015 A1* 10/2006 Shirasaki ..... G09G 3/325 345/77
2007/0001989 A1* 1/2007 Yoon ..... G11C 19/00 345/100
2013/0249955 A1* 9/2013 Kim ..... G09G 3/3233 345/690
2015/0123957 A1* 5/2015 Jun ..... G06T 7/0002 345/207
2018/0277037 A1* 9/2018 Lin ..... G06F 3/0412

* cited by examiner

*Primary Examiner* — Chad M Dicke
(74) *Attorney, Agent, or Firm* — Seed Intellectual Property Law Group LLP

(57) ABSTRACT

A display device includes a display panel in which a plurality of subpixels are arranged at positions at which a plurality of data lines and a plurality of gate lines overlap with each other. A gate driving circuit drives the plurality of subpixels via the plurality of gate lines. A data driving circuit supplies a data output signal to the plurality of subpixels via the plurality of data lines, and the data output signal includes a data voltage and an offset data voltage which is generated by adding an offset to the data voltage. A timing controller controls the gate driving circuit and the data driving circuit.

23 Claims, 11 Drawing Sheets

FIG.5

| Gray Scale | DATA | DATA(Offset) |
|---|---|---|
| 255 | 255 | 255 ± A |
| 191 | 191 | 191 ± B |
| 127 | 127 | 127 ± C |
| 63 | 63 | 63 ± D |
| 31 | 31 | 31 ± E |
| 15 | 15 | 15 ± F |
| 7 | 7 | 7 ± G |
| 1 | 1 | 1± H |
| 0 | 0 | 0 ± I |

DISPLAY DEVICE, DATA DRIVING CIRCUIT, AND DATA DRIVING METHOD HAVING OFFSET DATA VOLTAGE

CROSS REFERENCE TO RELATED APPLICATION

This application claims priority from Korean Patent Application No. 10-2019-0167406, filed on Dec. 16, 2019, which is hereby incorporated by reference for all purposes as if fully set forth herein.

BACKGROUND

Technical Field

The present disclosure relate to a display device, a data driving circuit, and a data driving method and more particularly to a display device, a data driving circuit, and a data driving method that may decrease a settling time of a data voltage and power consumption by applying an offset value to the data voltage.

Description of the Related Art

Examples of a flat panel display device include a liquid crystal display (LCD), a field emission display (FED), a plasma display panel (PDP), and an organic light emitting diode display (OLED).

In such a flat panel display device, a plurality of gate lines and a plurality of data lines are arranged to be perpendicular to each other and each area defined by intersection of one gate line and one data line is defined as a subpixel. Such subpixels are formed in a matrix in a display panel.

In order to drive the subpixels in the display panel, a scan signal is sequentially supplied to the plurality of gate lines and an image data voltage which is to be displayed is supplied to the subpixels which are turned on in response to the scan signal via the data lines.

A data driving circuit that supplies such a data voltage to the display panel is controlled by a timing controller that supplies a digital data signal, a clock signal for sampling the digital data signal, a control signal for controlling the operation of the data driving circuit, and the like via an interface such as a low-voltage differential signaling interface (LVDS).

The data driving circuit converts a digital data signal which is input in series from the timing controller to a parallel signal, converts the digital data signal to an analog data voltage using a gamma compensation voltage, and supplies the resultant via the data lines.

An end portion of the data driving circuit includes a driving amplifier that supplies a data voltage to the data lines, and power consumption in the driving amplifier is caused due to change of the data voltage which is supplied to the subpixels.

Recently, display devices with a large screen which may be driven at a high speed are desired in view of requests from users. A bias setting value is adjusted to decrease a settling time of a data voltage and to increase a slew rate according to a decrease in time interval of a horizontal period due to driving at a high speed.

BRIEF SUMMARY

However, when a bias setting value is adjusted to decrease a settling time of a data voltage which is supplied to the display panel and to increase a slew rate, there is a problem in that a constant current flowing in the driving amplifier of the data driving circuit increases and thus power consumption in the display device as a whole increases.

Therefore, the present disclosure provides a display device that may decrease a settling time of a data voltage and power consumption without increasing a constant current of a data driving circuit.

The present disclosure also provides a display device, a data driving circuit, and a data driving method that may decrease a settling time of a data voltage and power consumption by applying an offset value to the data voltage.

Objectives which are to be achieved by embodiments of the present disclosure are not limited to the above problems, and other objectives which have not been mentioned above will be apparently understood from the following description by those skilled in the art.

According to an embodiment of the present disclosure, there is provided a display device including: a display panel in which a plurality of subpixels are arranged at positions at which a plurality of data lines and a plurality of gate lines overlap with each other; a gate driving circuit that drives the plurality of subpixels via the plurality of gate lines; a data driving circuit that supplies a data output signal to the plurality of subpixels via the plurality of data lines, the data output signal including a data voltage and an offset data voltage which is generated by adding an offset to the data voltage; and a timing controller that controls the gate driving circuit and the data driving circuit.

In the display device according to the embodiment of the present disclosure, the data driving circuit may include: a data controller that generates offset image data by adding an offset to digital image data which is received from the timing controller; a first latch circuit that stores the digital image data received from the data controller; a first offset latch circuit that stores the offset image data received from the data controller; a second latch circuit that stores the digital image data and the offset image data which are respectively transmitted from the first latch circuit and the first offset latch circuit; a digital-analog converter that converts the digital image data and the offset image data transmitted from the second latch circuit to a data voltage and an offset data voltage; and an output buffer that supplies the data voltage and the offset data voltage to a display panel under the control of the data controller.

In the display device according to the embodiment of the present disclosure, the data controller may include a lookup table in which the digital image data and the offset image data are stored.

In the display device according to the embodiment of the present disclosure, the output buffer may include a driving amplifier that supplies the data voltage or the offset data voltage to the display panel based on a bias voltage.

In the display device according to the embodiment of the present disclosure, the offset may be varied based on a gray scale of the digital image data.

In the display device according to the embodiment of the present disclosure, the offset may be determined by applying an interpolation method to gray scales of intermediate levels.

In the display device according to the embodiment of the present disclosure, the data controller may control the offset data voltage to be supplied to the display panel for an offset time in a data enable section.

In the display device according to the embodiment of the present disclosure, the offset time may have an interval which is equal to or greater than a time from a start time point of the data enable section to a time point at which the offset data voltage reaches a stabilization level of the data voltage.

In the display device according to the embodiment of the present disclosure, the second latch circuit may include: a second normal latch circuit that stores the digital image data which is transmitted from the first latch circuit; and a second offset latch circuit that stores the offset image data which is transmitted from the first offset latch circuit.

According to another embodiment of the present disclosure, there is provided a data driving circuit including: a data controller that generates offset image data by adding an offset to digital image data which is received from a timing controller; a first latch circuit that stores the digital image data received from the data controller; a first offset latch circuit that stores the offset image data received from the data controller; a second latch circuit that stores the digital image data and the offset image data which are respectively transmitted from the first latch circuit and the first offset latch circuit; a digital-analog converter that converts the digital image data and the offset image data transmitted from the second latch circuit to a data voltage and an offset data voltage; and an output buffer that supplies the data voltage and the offset data voltage to a display panel under the control of the data controller.

According to still another embodiment of the present disclosure, there is provided a data driving method including: generating offset image data by adding an offset to digital image data which is received from a timing controller; storing the digital image data and the offset image data; converting the digital image data and the offset image data to a data voltage and an offset data which are of an analog type; and supplying the data voltage and the offset data voltage to a display panel at different times.

According to the embodiments of the present disclosure, it is possible to provide a display device that may decrease a settling time of a data voltage and power consumption without increasing a constant current of a data driving circuit.

According to the embodiments of the present disclosure, it is possible to provide a display device, a data driving circuit, and a data driving method that may decrease a settling time of a data voltage and power consumption by applying an offset value to the data voltage.

Advantages of the embodiments of the present disclosure are not limited to the above advantages. The embodiments of the present disclosure may achieve advantages which have not been mentioned above and will be apparently understood from the following description by those skilled in the art.

BRIEF DESCRIPTION OF THE SEVERAL VIEWS OF THE DRAWINGS

FIG. 5 is a diagram illustrating an example of a lookup table in which digital image data and offset image data are stored in a display device according to an embodiment of the present disclosure;

DETAILED DESCRIPTION

Figure 1:
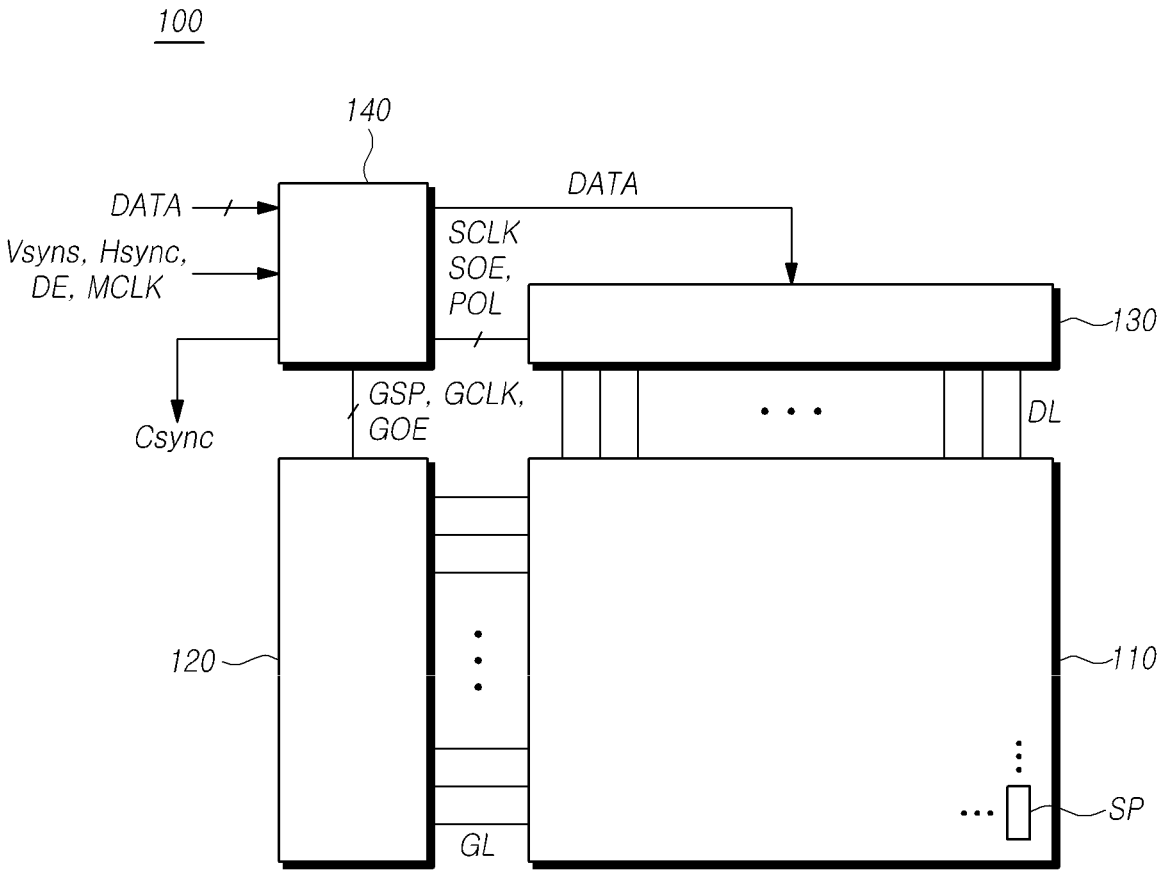
FIG. 1 is a diagram schematically illustrating a configuration of a bendable display device according to an embodiment of the present disclosure.

Advantages and features of the present disclosure and methods for achieving the advantages or features will be apparent from embodiments described below in detail with reference to the accompanying drawings. However, the disclosure is not limited to the embodiments but may be modified in various forms. The embodiments are provided merely for completing the disclosure of the disclosure and are provided for completely informing those skilled in the art of the scope of the disclosure.

Shapes, sizes, ratios, angles, number of pieces, and the like illustrated in the drawings, which are provided for the purpose of explaining the embodiments of the disclosure, are provided as just some examples, and thus the disclosure is not limited to the illustrated details. In the following description, like elements are referenced by like reference numerals. When it is determined that detailed description of the relevant known functions or configurations involved in the disclosure makes the gist of the disclosure obscure, the detailed description thereof will not be made. When "include," "have", "be constituted", and the like are mentioned in the specification, another element may be added unless "only" is used. A singular expression of an element includes two or more elements unless differently mentioned.

In construing elements in embodiments of the disclosure, an error range is included even when explicit description is not made.

For example, when positional relationships between two parts are described using 'on,' 'over,' and the like, one or more other parts may be disposed between the two parts unless 'just' or 'direct' is used.

In describing temporal relationships, for example, when the temporal order is described using 'after,' 'subsequent,' 'next,' and 'before,' a case which is not continuous may be included unless 'just' or 'direct' is used.

In describing signal transmission relationships, for example, when 'a signal is transmitted from node A to node B,' a case in which the signal is transmitted from node A to node B via another node may be included unless 'just' or 'direct' is used.

It will be understood that, although the terms "first," "second," and the like may be used herein to describe various elements, these elements should not be limited by these terms. These terms are only used to distinguish one element from another. For example, a first element could be termed a second element, and, similarly, a second element could be termed a first element, without departing from the scope of the present disclosure.

Features (elements) of embodiments of the disclosure may be coupled or combined with each other or separated from each other partially or on the whole and may be technically interlinked and driven in various forms. The embodiments may be put into practice independently or in combination.

Hereinafter, various embodiments of the present disclosure will be described in detail with reference to the accompanying drawings.

FIG. 1 is a diagram schematically illustrating a configuration of a display device according to an embodiment of the present disclosure.

Referring to FIG. 1, a display device 100 according to an embodiment of the present disclosure includes a display panel 110, a gate driving circuit 120, a data driving circuit 130, and a timing controller (T-CON) 140.

The display panel 110 displays an image on the basis of a scan signal SCAN which is transmitted from the gate driving circuit 120 via a plurality of gate lines GL and a data voltage Vdata which is transmitted from the data driving circuit 130 via a plurality of data lines DL.

The display panel 110 includes a liquid crystal layer which is formed between two substrates and may operate in any known mode such as a twisted nematic (TN) mode, a vertical alignment (VA) mode, an in-plane switching (IPS) mode, a fringe field switching (FFS) mode.

A plurality of subpixels SP constituting the display panel 110 are defined by the plurality of data lines DL and the plurality of gate lines GL. Each subpixel SP includes a thin film transistor TFT that is formed in an area in which one data line DL and one gate line GL intersect (e.g., overlap) each other, a light emitting element such as an organic light emitting diode (OLED) that is charged with a data voltage Vdata, and a storage capacitor Cst that is electrically connected to the light emitting element and stores a voltage. As used herein, the term "intersect" or "intersection" does not necessarily imply physical or electrical connection or intersection between elements, but instead may mean that two or more elements are arranged in an overlapping manner, with one or more elements disposed between the overlapping two or more elements.

For example, a display device 100 with a resolution of 2,160×3,840 includes 2,160 gate lines GL and 3,840 data lines DL, and subpixels SP are arranged at positions at which the gate lines GL and the data lines DL intersect (e.g., overlap) each other.

A timing controller 140 controls the gate driving circuit 120 and the data driving circuit 130. The timing controller 140 is supplied with timing signals such as a vertical synchronization signal Vsync, a horizontal synchronization signal Hsync, a data enable signal DE, and a main clock MCLK and digital image data DATA from a host system (not illustrated in the drawing).

The timing controller 140 controls the gate driving circuit 120 on the basis of scan timing control signals such as a gate start pulse GSP, a gate clock signal GCLK, and a gate output enable signal GOE. The timing controller 140 controls the data driving circuit 130 on the basis of data timing control signals such as a source sampling clock signal SCLK, a polarity control signal POL, and a source output enable signal SOE.

The gate driving circuit 120 sequentially drives a plurality of gate lines GL by sequentially supplying a scan signal SCAN to the display panel 110 via a plurality of gate lines GL. Here, the gate driving circuit 120 is also referred to as a scan driving circuit or a gate driver IC (GDIC).

The gate driving circuit 120 includes one or more gate driver ICs (GDIC) and may be disposed on only one side of the display panel 110 or on both sides depending on a drive mode. Alternatively, the gate driving circuit 120 may be incorporated into a bezel area of the display panel 110 and embodied in the form of a gate in panel (GIP).

The gate driving circuit 120 sequentially supplies a scan signal SCAN of an ON voltage or an OFF voltage to a plurality of gate lines GL under the control of the timing controller 140. For this purpose, the gate driving circuit 120 includes a shift register or a level shifter.

The data driving circuit 130 is supplied with digital image data DATA from the timing controller 140 and drives a plurality of data lines DL by converting the digital image data DATA to a data voltage Vdata of an analog type and supplying the data voltage Vdata to the plurality of data lines DL. Here, the data driving circuit 130 is also referred to as a source driving circuit or a source driver IC (SDIC).

The data driving circuit 130 includes one or more source driver ICs (SDIC). The source driver IC may be connected to bonding pads of the display panel 110 in a tape automated bonding (TAB) manner or a chip on glass (COG) manner or may be disposed directly on the display panel 110. In some cases, each source driver IC (SDIC) may be integrated and disposed on the display panel 110. Each source driver IC (SDIC) is embodied in a chip on film (COF) manner. In this case, each source driver IC is mounted on a circuit film and is electrically connected to the data lines DL of the display panel 110 via the circuit film.

When a specific gate line GL is turned on by the gate driving circuit 120, the data driving circuit 130 converts digital image data DATA received from the timing controller 140 to a data voltage Vdata of an analog type and supplies the data voltage Vdata to a plurality of data lines DL.

The data driving circuit 130 may be disposed in only one of an upper part and a lower part of the display panel 110 or may be disposed in both the upper part and the lower part of the display panel 110 depending on a drive mode or a design mode.

The data driving circuit 130 includes a shift register, a latch circuit, a digital-analog converter DAC, and an output buffer. Here, the digital-analog converter DAC is an element that converts digital image data DATA received from the timing controller 140 to a data voltage Vdata of an analog type to supply the data voltage Vdata to the data lines DL.

On the other hand, the display device 100 further includes a memory. The memory temporarily stores digital image data DATA which is output from the timing controller 140 and outputs the digital image data DATA to the data driving circuit 130 at a predetermined time. The memory may be disposed inside or outside the data driving circuit 130. When the memory is disposed outside the data driving circuit 130, the memory may be disposed between the timing controller 140 and the data driving circuit 130. The memory further includes a buffer memory that stores digital image data DATA which is received from the outside and supplies the stored digital image data DATA to the timing controller 140.

In addition, the display device 100 includes an interface for input and output of signals to and from another external electronic device or an external electronic component or communication therewith. The interface includes, for example, one or more of a low-voltage differential signaling interface (LVDS), a mobile industry processor interface (MIPI), and a serial interface.

Examples of the display device 100 include a liquid crystal display device, an organic light emitting display device, and a plasma display device.

Figure 2:
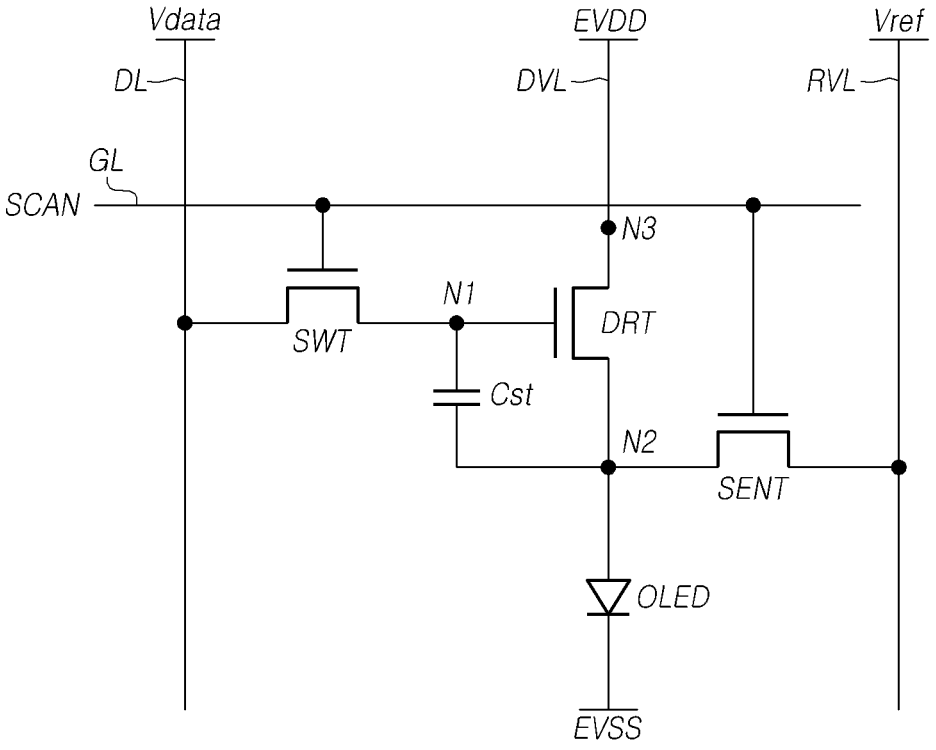
FIG. 2 is a diagram illustrating a circuit structure of each subpixel which is arranged in a display device according to an embodiment of the present disclosure.

FIG. 2 is a diagram illustrating a circuit structure of a subpixel which is disposed in the display device according to the embodiment of the present disclosure.

Referring to FIG. 2, each subpixel SP disposed in the display device 100 according to the embodiment of the present disclosure includes one or more transistors and a capacitor and includes an organic light emitting diode OLED as a light emitting element.

For example, a subpixel SP includes a driving transistor DRT, a switching transistor SWT, a sensing transistor SENT, a storage capacitor Cst, and an organic light emitting diode OLED.

The driving transistor DRT includes a first node N1, a second node N2, and a third node N3. The first node N1 of the driving transistor DRT is a gate node to which a data voltage Vdata is applied via the corresponding data line DL when the switching transistor SWT is turned on. The second node N2 of the driving transistor DRT is electrically connected to an anode electrode of the organic light emitting diode OLED and is a source node or a drain node. The third node N3 of the driving transistor DRT is electrically connected to a driving voltage line DVL to which a driving voltage EVDD is applied and is a drain node or a source node.

In an image drive period, a driving voltage EVDD required for image drive is supplied via the driving voltage line DVL. For example, the driving voltage EVDD required for image drive may be 27 V.

The switching transistor SWT is electrically connected between the first node N1 of the driving transistor DRT and the corresponding data line DL, includes a gate node connected to the corresponding gate line GL, and operates in response to a scan signal SCAN which is supplied via the gate line GL. When the switching transistor SWT is turned on, the switching transistor SWT transmits the data voltage Vdata which is supplied via the data line DL to the gate node of the driving transistor DRT to control the operation of the driving transistor DRT.

The sensing transistor SENT is electrically connected between the second node N2 of the driving transistor DRT and a reference voltage line RVL, includes a gate node connected to the corresponding gate line GL, and operates in response to a scan signal SCAN which is supplied via the gate line GL. When the sensing transistor SENT is turned on, the sensing transistor SENT transmits a sensing reference voltage Vref which is supplied via the reference voltage line RVL to the second node N2 of the driving transistor DRT.

That is, the voltage of the first node N1 and the voltage of the second node N2 of the driving transistor may be controlled by controlling the switching transistor SWT and the sensing transistor SENT, and thus a current for driving the organic light emitting diode OLED may be supplied.

The switching transistor SWT and the sensing transistor SENT may be connected to the same gate line GL or may be connected to different signal lines. In this example, the switching transistor SWT and the sensing transistor SENT are connected to the same gate line GL. In this case, the switching transistor SWT and the sensing transistor SENT may be simultaneously controlled using the scan signal SCAN which is transmitted via the single gate line GL, and an aperture ratio of the subpixel SP may be improved.

On the other hand, the transistors which are provided in each subpixel SP may be formed as n-type transistors or p-type transistors, and are assumed to be formed as n-type transistors.

The storage capacitor Cst is electrically connected between the first node N1 and the second node N2 of the driving transistor DRT, and holds the data voltage Vdata in one frame.

The storage capacitor Cst may be connected between the first node N1 and the third node N3 of the driving transistor DRT depending on the type of the driving transistor DRT. The anode electrode of the organic light emitting diode OLED is electrically connected to the second node N2 of the driving transistor DRT, and a base voltage EVSS is applied to the cathode electrode of the organic light emitting diode OLED. Here, the base voltage EVSS may be a ground voltage or may be higher or lower than the ground voltage. The base voltage EVSS may be varied may depending on a driving state. For example, the base voltage EVSS at an image drive time point and the base voltage EVSS at a sensing drive time point may be set to be different from each other.

Figure 3:
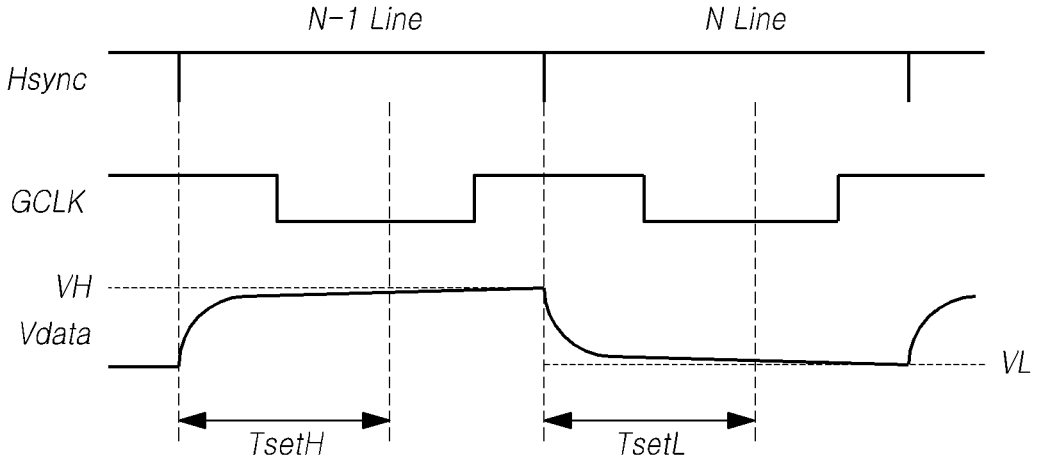
FIG. 3 is a graph illustrating a waveform of a data voltage which is applied to a display panel via a data driving circuit in the display device.

FIG. 3 is a graph illustrating a waveform of a data voltage which is applied to a display panel via a data driving circuit in a display device according to the related art.

Referring to FIG. 3, at the timing at which the data driving circuit 130 of the display device is operated for a specific horizontal line of the display panel 110 which is selected by a horizontal synchronization signal Hsync in response to a gate clock signal GCLK (operated in response to a gate clock signal of a low level), a data voltage Vdata to subpixels SP which are designated by applying a data enable signal to the data driving circuit 130 is supplied.

The horizontal synchronization signal Hsync and the gate clock signal GCLK are digital signals, and the data voltage Vdata which is output from the data driving circuit 130 is an analog signal.

As described above, since each subpixel SP constituting the display panel 110 includes the storage capacitor Cst, the storage capacitor Cst requires a certain settling time TsetH or TsetL in the course of increasing the data voltage Vdata to a high level data voltage VH or decreasing the data voltage Vdata to a low level data voltage VL. Here, the high level data voltage VH or the low level data voltage VL is a voltage level at which the data voltage Vdata is stabilized.

Accordingly, in order to make the data voltage Vdata output to the display panel 110 be the high level data voltage VH or the low level data voltage VL corresponding to a saturated state, the storage capacitor Cst of the subpixel SP needs to be fully charged or discharged before the gate clock signal GCLK is transited to a low level.

That is, the gate clock signal GCLK has to be enabled after the settling time TsetH or TsetL has elapsed.

However, since a time interval of a horizontal period decreases to constitute the display panel 110 with a high resolution and to drive the display panel 110 at a high speed, a bias set value of the data driving circuit 130 may be adjusted to decrease the settling time TsetH or TsetL and to increase a slew rate, and thus there is a problem in that a constant current flowing in a driving amplifier of the data driving circuit 130 increases and power consumption increases rapidly.

Particularly, the driving amplifier that converts digital image data DATA to a data voltage Vdata of an analog type in the data driving circuit 130 occupies 60% or more of the total power consumption, and thus serves as a main factor that increases the total power consumption of the display device 100.

The inventors of the present disclosure found that the settling time of the data voltage Vdata and the power consumption may be decreased by applying an offset Offset to the data voltage Vdata which is applied to the display panel 110 by the data driving circuit 130.

Figure 4:
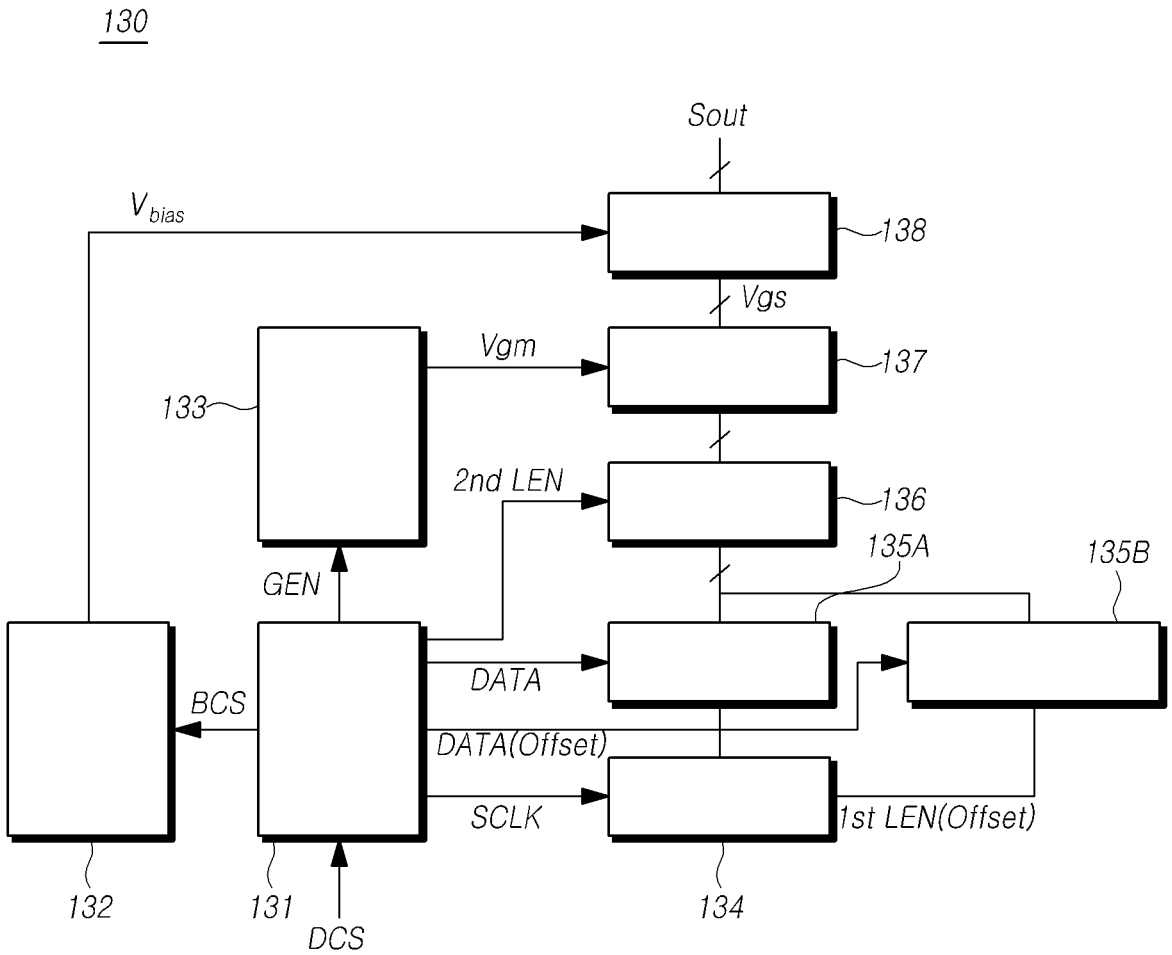
FIG. 4 is a block diagram illustrating a data driving circuit in a display device according to an embodiment of the present disclosure.

FIG. 4 is a block diagram illustrating a data driving circuit in a display device according to an embodiment of the present disclosure.

Referring to FIG. 4, the data driving circuit 130 in the display device 100 according to the embodiment of the present disclosure includes a data controller 131, a bias voltage generating circuit 132, a gamma reference voltage generating circuit 133, a shift register 134, a first latch circuit 135A, a first offset latch circuit 135B, a second latch circuit 136, a digital-analog converter 137, and an output buffer 138.

The data controller 131 receives a data control signal DCS from the timing controller 140 and controls the level of a data output signal Sout which is applied to the display panel 110 on the basis of the data control signal DCS.

The data controller 131 generates a bias control signal BCS for adjusting the level of a bias voltage Vbias which is applied to driving amplifiers of the output buffer 138.

The data controller 131 generates a gamma enable signal GEN. The gamma enable signal GEN controls the gamma reference voltage generating circuit 133 such that a gamma reference voltage Vgm is generated. The gamma reference voltage Vgm is used to convert digital image data DATA supplied from the timing controller 140 to a data voltage Vdata of an analog type in gray scales.

The data driving circuit 130 according to the embodiment of the present disclosure may decrease the settling time TsetH or TsetL of the data voltage Vdata and the power consumption by generating offset image data DATA(Offset) obtained by adding an offset to the digital image data DATA which is supplied from the timing controller 140 and supplying an offset data voltage Vdata(Offset) corresponding to the offset image data DATA(Offset) to the horizontal line of the display panel 110 in an offset time section before the gate clock signal GCLK is enabled.

The data controller 131 generates the offset image data DATA(Offset) in which an offset is applied to the digital image data DATA on the basis of the digital image data DATA supplied from the timing controller 140 and gray scales, and includes a lookup table that stores the generated offset image data DATA(Offset) together.

FIG. 5 is a diagram illustrating an example of a lookup table in which digital image data and offset image data are stored in the display device according to the embodiment of the present disclosure.

Referring to FIG. 5, digital image data DATA supplied from the timing controller 140 and offset image data DATA (Offset) in which an offset is applied thereto are stored together in the lookup table in the display device 100 according to the embodiment of the present disclosure.

The lookup table may be disposed inside the data controller 131 or may be disposed outside the data controller 131.

The offset which is applied to the digital image data DATA may vary depending on gray scales of the digital image data DATA. For example, when gray scales are applied from 0 to 256, an offset value A is applied for the digital image data DATA corresponds to the gray scale of 255.

An offset value +A is applied in a section in which the digital image data DATA increases to the gray scale of 255, and an offset value −A is applied in a section in which the digital image data DATA decreases to the gray scale of 255.

This offset value varies depending on the gray scale. For example, an offset value B is applied to the digital image data DATA corresponding to the gray scale of 191, and an offset value I is applied to the digital image data DATA corresponding to the gray scale of 0.

At this time, the offset value applied to the digital image data DATA may be determined independently for each gray scale, or the offset value may be determined to satisfy a predetermined function by applying interpolation to the offset value A and the offset value I for gray scales corresponding to intermediate levels after the offset value A applied to the digital image data DATA corresponding to the gray scale of 255 and the offset value I applied to the digital image data DATA corresponding to the gray scale of 0 have been determined.

When the interpolation method is used for the gray scales of intermediate levels, the gray scale range to which the interpolation method is applied may change variously.

The data controller 131 stores the digital image data DATA received from the timing controller 140 and the offset image data DATA(Offset) with an offset value applied to the digital image data DATA together in the lookup table.

The data controller 131 transmits the digital image data DATA stored in the lookup table to the first latch circuit 135A and transmits the offset image data DATA(Offset) with an offset value to the first offset latch circuit 135B.

The bias voltage generating circuit 132 generates a bias voltage Vbias with various voltage levels in response to a bias control signal BCS.

The gamma reference voltage generating circuit 133 receives an gamma enable signal GEN and generates a gamma reference voltage Vgm with various voltage levels.

The shift register 134 generates a first latch enable signal 1st LEN for operating the first latch circuit 135A and a first offset latch enable signal 1st LEN(Offset) for operating the first offset latch circuit 135B on the basis of a source sampling clock signal SCLK.

The first latch enable signal 1st LEN may control the timing at which the digital image data DATA stored in the second latch circuit 136 via the first latch circuit 135A is output to the display panel 110.

The first offset latch enable signal 1st LEN(Offset) may control the timing at which the offset image data DATA (Offset) stored in the second latch circuit 136 via the first offset latch circuit 135B is output to the display panel 110.

The first latch circuit 135A temporarily stores the digital image data DATA which is received from the data controller 131. The digital image data DATA may be sequentially stored in the first latch circuit 135A to correspond to positions at which the digital image data DATA is output to the display panel 110.

The first offset latch circuit 135B temporarily stores the offset image data DATA(Offset) which is received from the data controller 131. The offset image data DATA(Offset) may be sequentially stored in the first offset latch circuit 135B to correspond to positions at which the offset image data DATA(Offset) is output to the display panel 110.

The first latch circuit 135A may transmit the latched digital image data DATA to the second latch circuit 136 at a desired timing under the control of the first latch enable signal 1st LEN which is received from the shift register 134. The first offset latch circuit 135B may transmit the latched offset image data DATA(Offset) to the second latch circuit 136 at a desired timing under the control of the first offset latch enable signal 1st LEN(Offset) which is received from the shift register 134.

The second latch circuit 136 receives the digital image data DATA stored in the first latch circuit 135A and the offset image data DATA(Offset) stored in the first offset latch circuit 135B.

The second latch circuit 136 receives a second latch enable signal 2nd LEN from the data controller 131 and transmits the digital image data DATA or the offset image data DATA(Offset) to the digital-analog converter 137.

Here, the second latch enable signal 2nd LEN controls an offset data voltage Vdata(Offset) corresponding to the offset image data DATA(Offset) to be output during a predetermined offset time at a time point at which a data voltage Vdata of an analog type is applied to the horizontal lines of the display panel 110. The second latch enable signal 2nd LEN may control the data voltage Vdata corresponding to the digital image data DATA to be output when an offset time in which the offset data voltage Vdata(Offset) is output elapses.

The digital-analog converter 137 converts the digital image data DATA or the offset image data DATA(Offset) transmitted to the digital-analog converter 137 to a gray-scale voltage Vgs using the gamma reference voltage Vgm received from the gamma reference voltage generating circuit 133.

The output buffer 138 includes a plurality of driving amplifiers and each driving amplifier outputs a data output signal Sout to the display panel 110 on the basis of the gray-scale voltage Vgs received from the digital-analog converter 137. The data output signal Sout includes the data voltage Vdata corresponding to the digital image data DATA or the offset data voltage Vdata(Offset) corresponding to the offset image data DATA(Offset).

Accordingly, the data output signal Sout which is applied to the display panel 110 via the output buffer 138 is the offset data voltage Vdata(Offset) with an offset applied thereto during a first offset time in a data enable section and is the data voltage Vdata without an offset applied thereto after the offset time has elapsed.

Figure 6:
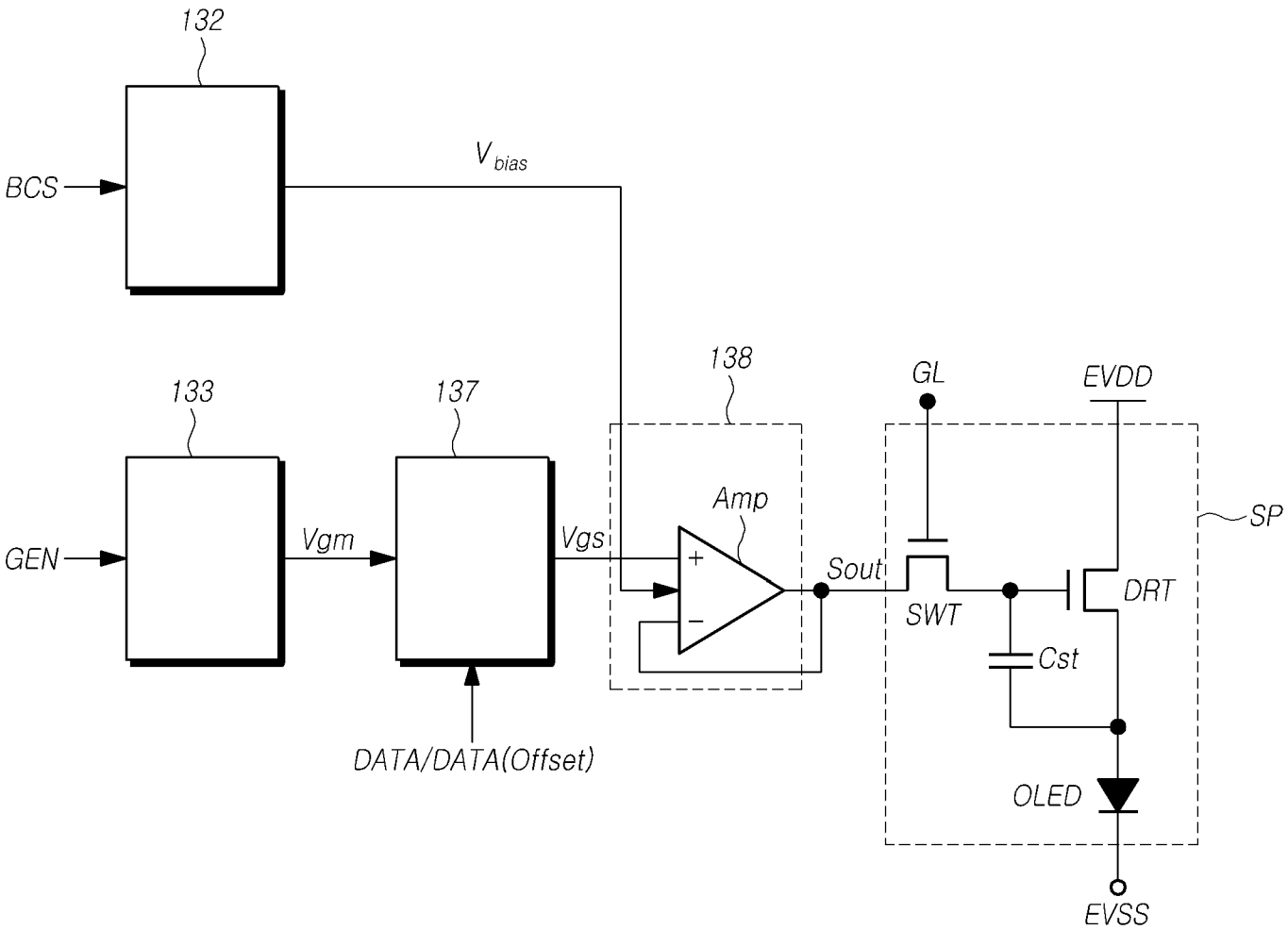
FIG. 6 is a diagram illustrating a data driving circuit and a part of a subpixel in a display device according to an embodiment of the present disclosure.

FIG. 6 is a diagram illustrating a part of a data driving circuit and a subpixel in the display device according to the embodiment of the present disclosure.

Referring to FIG. 6, the output buffer 138 constituting the data driving circuit 130 in the display device 100 according to the embodiment of the present disclosure includes a driving amplifier Amp. Herein, one digital-analog converter 137 required for driving one subpixel SP and one driving amplifier Amp included in the output buffer 138 are illustrated.

The driving amplifier Amp receives a gray-scale voltage Vgs from the digital-analog converter 137 and amplifies the gray-scale voltage Vgs depending on the level of the bias voltage Vbias.

The data output signal Sout which is amplified by the driving amplifier Amp includes the data voltage Vdata corresponding to the digital image data DATA or the offset data voltage Vdata(Offset) corresponding to the offset image data DATA(Offset).

Here, the data output signal Sout which is output to a subpixel SP disposed in the display panel 110 is the offset data voltage Vdata(Offset) with an offset applied thereto during a first offset time and is the data voltage Vdata without an offset applied thereto after the offset time has elapsed.

Accordingly, it is possible to decrease the settling time TsetH or TsetL of the data output signal Sout which is supplied to the display panel 110 using the offset data voltage Vdata(Offset) and to decrease power consumption.

Figure 7:
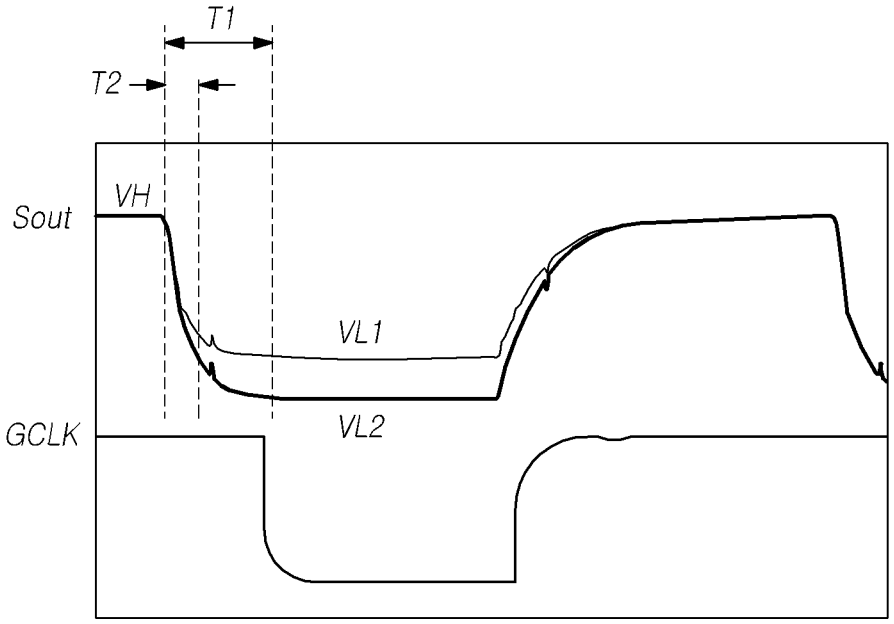
FIG. 7 is a diagram illustrating an example of an experimental graph for an offset set value and an offset time in a display device according to an embodiment of the present disclosure.

FIG. 7 is a diagram illustrating an example of an experimental graph of an offset set value and an offset time in the display device according to the embodiment of the present disclosure.

Referring to FIG. 7, the data output signal Sout which is applied to the display panel 110 in the display device 100 according to the embodiment of the present disclosure should be output at a timing before the gate clock signal GCLK is transited from a high level to a low level in the data enable section. Here, a time T1 is required from a data enable start time point to a time point at which the gate clock signal GCLK is transited to a low level.

For example, when the data output signal Sout which is applied to the display panel 110 changes from VH to VL1, the data output signal Sout should be stabilized from VH to VL1 within the time T1 and thus the settling time TsetL should be set to be less than T1.

Here, the high level data voltage VH and the low level data voltage VL in the digital image data DATA is stored in the lookup table.

When the data voltage of a low level VL2 is changed to the offset data voltage Vdata(Offset) by applying a predetermined offset to the digital image data DATA, a time T2 is required until the data output signal Sout reaches the level VL1. That is, when a predetermined offset is applied, a time T1-T2 is shortened until the data output signal reaches the data voltage of a low level VL1.

In this way, when the data output signal Sout is generated until it reaches the low level data voltage VL using the offset image data DATA(Offset) and then the data output signal Sout is generated using the digital image data DATA without an offset applied thereto, the settling time TsetL required until the data output signal Sout is stabilized at the low level data voltage VL may be decreased.

In this case, the offset time Tos in which the data output signal Sout is generated using the offset image data DATA (Offset) is set to T2 corresponding to the time until it reaches the low level data voltage of VL1 or a little bit greater time.

In this embodiment, the data output signal Sout decreases from a high level to a low level, but the same is true of a case in which the data output signal Sout increases from a low level to a high level.

Figure 8:
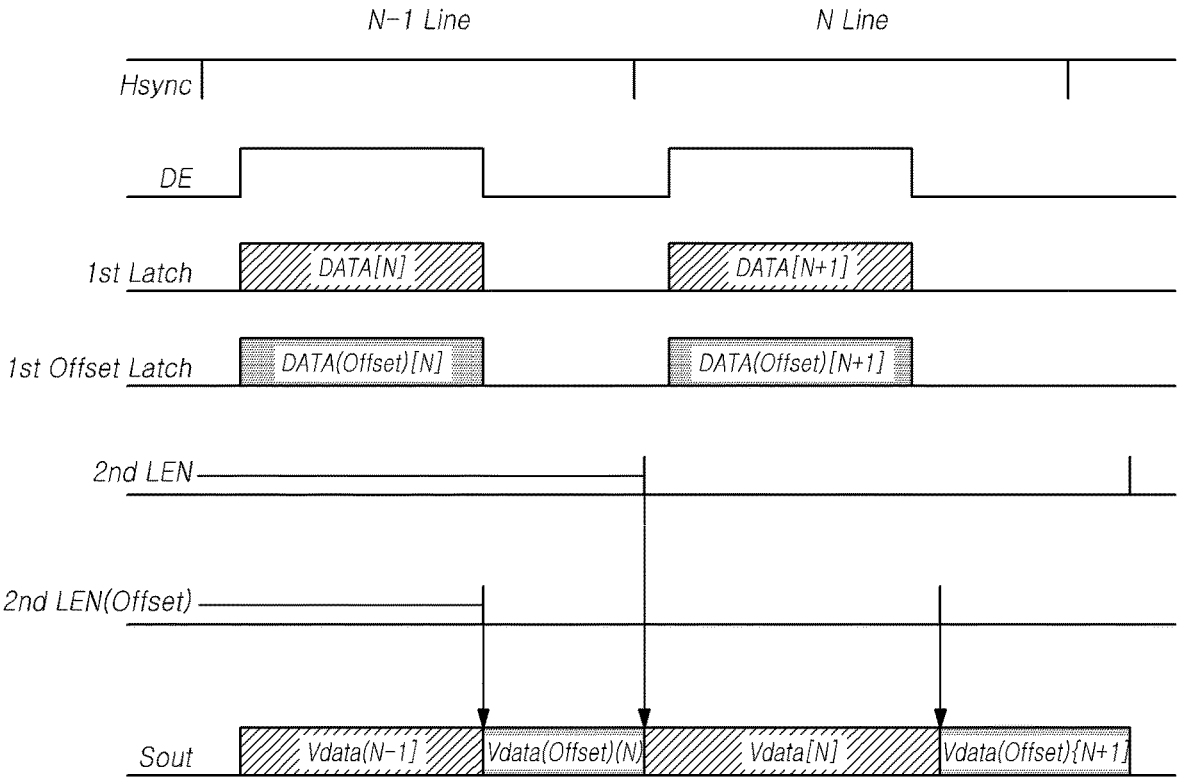
FIG. 8 is a graph illustrating timings of signals which are applied to a display panel via a data driving circuit in a display device according to an embodiment of the present disclosure.

FIG. 8 is a graph illustrating an example of timings of signals which are applied to the display panel via the data driving circuit of the display device according to the embodiment of the present disclosure.

Referring to FIG. 8, the data driving circuit 130 of the display device 100 according to the embodiment of the present disclosure supplies the data output signal Sout to a subpixel SP which is designated in the data enable section in which the data enable signal DE of a high level is applied to a specific horizontal line of the display panel 110 selected by the horizontal synchronization signal Hsync.

Accordingly, in the data enable section, the data controller 131 transmits the digital image data DATA stored in the lookup table to the first latch circuit 1st Latch and transmits the offset image data DATA(Offset) with an offset value applied thereto to the first offset latch circuit 1st Offset Latch.

Accordingly, the first latch circuit 1st Latch temporarily stores the digital image data DATA received from the data controller 131 and the first offset latch circuit 1st Offset Latch temporarily stores the offset image data DATA(Offset) received from the data controller 131.

The digital image data DATA and the offset image data DATA(Offset) are transmitted to the second latch circuit 2nd Latch depend on the first latch enable signal 1st LEN and the first offset latch enable signal 1st LEN(Offset) which are generated by the shift register 134.

The second latch circuit 2nd Latch receives a second latch enable signal 2nd LEN from the data controller 131 and transmits the digital image data DATA or the offset image data DATA(Offset) to the digital-analog converter 137.

Here, the second latch enable signal 2nd LEN is a signal for controlling the digital image data DATA stored in the second latch circuit 2nd Latch to be output, and includes the second offset latch enable signal 2nd LEN(Offset) for controlling the offset image data DATA(Offset) to be output.

Accordingly, the offset image data DATA(Offset) is output from the second latch circuit 2nd Latch in the offset time Tos in which the second Offset latch enable signal 2nd LEN(Offset) is supplied from the data controller 131. As a result, the data output signal Sout which is applied to the display panel 110 via the driving amplifier Amp of the output buffer 138 in the offset time Tos is the offset data voltage Vdata(Offset) corresponding to the offset image data DATA (Offset).

After the offset time Tos has elapsed, the digital image data DATA is output from the second latch circuit 2nd Latch. As a result, the data output signal Sout which is applied to the display panel 110 via the driving amplifier Amp of the output buffer 138 in a time section after the offset time Tos has elapsed is the data voltage Vdata corresponding to the digital image data DATA.

Accordingly, by using the offset data voltage Vdata(Offset) which is output to the display panel 110 in the offset time Tos, it is possible to decrease the settling time TsetH or TsetL of the data output signal Sout which is supplied to the display panel 110 and to decrease the power consumption.

Figure 9:
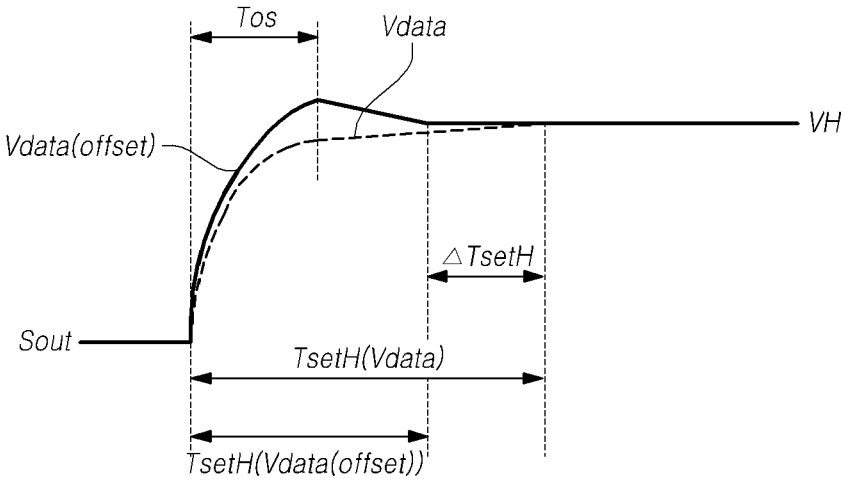
FIG. 9 is a graph illustrating an advantage in which a settling time is decreased by an offset data voltage in a display device according to an embodiment of the present disclosure.
Figure 10:
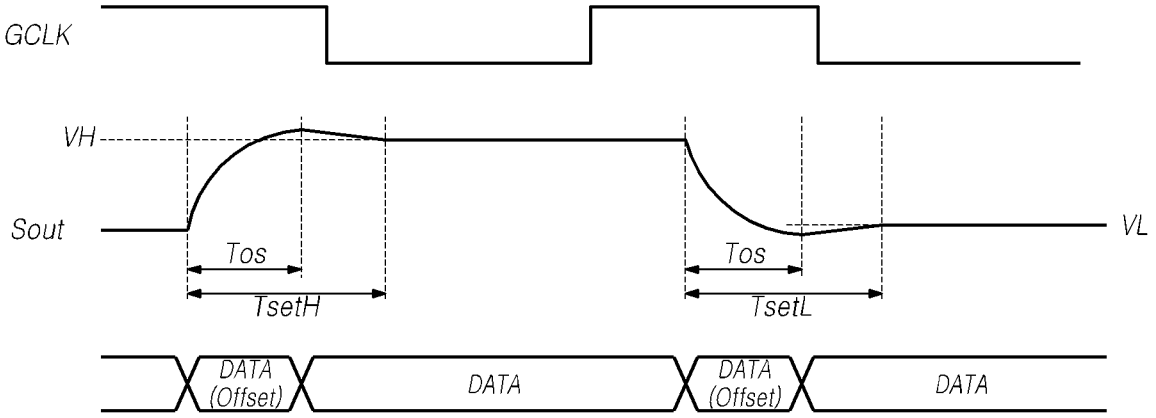
FIG. 10 is a graph illustrating a waveform of a data output signal which is applied to a display panel using an offset data voltage in a display device according to an embodiment of the present disclosure.

FIG. 9 is a graph illustrating an advantage in which the settling time is decreased using the offset data voltage in the display device according to the embodiment of the present disclosure. FIG. 10 is a graph illustrating a waveform of a data output signal which is applied to the display panel using the offset data voltage in the display device according to the embodiment of the present disclosure.

Referring to FIGS. 9 and 10, the data output signal Sout which is applied to the display panel 110 by the data driving circuit 130 is the data voltage Vdata corresponding to the digital image data DATA which is supplied from the timing controller 140 to the data driving circuit 130. The display device 100 according to the embodiment of the present disclosure may decrease the settling time TsetH or TsetL by outputting the offset data voltage Vdata(Offset) corresponding to the offset image data DATA(Offset) with an offset applied to the digital image data DATA in the offset time Tos with a predetermined interval from the time point at which the data voltage Vdata is applied.

That is, the data driving circuit 130 may decrease a time until the data output signal Sout reaches the high level data voltage VH or the low level data voltage VL by outputting the offset data voltage Vdata(Offset) corresponding to the offset image data DATA(Offset) in the offset time Tos, and may allow the data signal Sout to be stably maintained at the high level data voltage VH or the low level data voltage VL by outputting the data voltage Vdata corresponding to the digital image data DATA after the offset time Tos has elapsed.

As a result, it may be understood that the settling time TsetH(Vdata(Offset)) obtained by outputting the offset data voltage Vdata(Offset) in the offset time Tos is decreased more than the settling time TsetH(Vdata) obtained by outputting only the data voltage Vdata without considering an offset time Tos in which the offset data voltage Vdata(Offset) is output.

Accordingly, with the display device 100 according to the embodiment of the present disclosure, it is possible to decrease the settling time TsetH or TsetL of the data output signal Sout without increasing the bias set value which is applied to the data driving circuit 130 even when the time interval of the horizontal period is decreased due to fast drive thereof and thus to decrease the total power consumption by decreasing the constant current which is supplied to the driving amplifier Amp.

On the other hand, it has been described above that the digital image data DATA of the first latch circuit 135A and the offset image data DATA(Offset) of the first offset latch circuit 135B are supplied to one second latch circuit 136 and the timings at which the digital image data DATA and the offset image data DATA(Offset) are supplied are controlled by one second latch circuit 136, but second latch circuits 136 that control the supply timings of the digital image data DATA and the offset image data DATA(Offset), respectively, may be separated.

Figure 11:
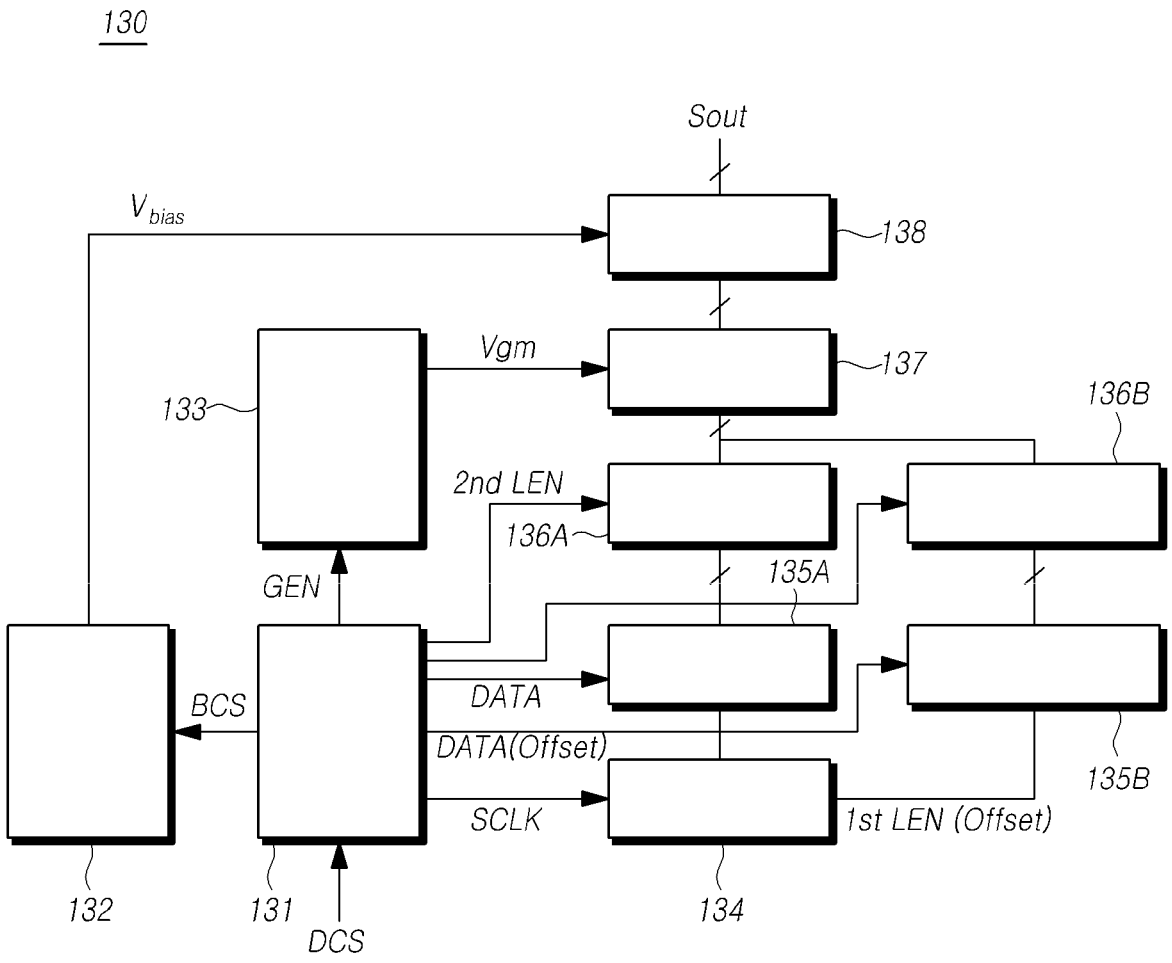
FIG. 11 is a block diagram illustrating a data driving circuit in a display device according to another embodiment of the present disclosure.

FIG. 11 is a block diagram illustrating a data driving circuit in a display device according to another embodiment of the present disclosure.

Referring to FIG. 11, a data driving circuit 130 in a display device 100 according to another embodiment of the present disclosure includes a data controller 131, a bias voltage generating circuit 132, a gamma reference voltage generating circuit 133, a shift register 134, a first latch circuit 135A, a first offset latch circuit 135B, a second latch circuit 136A, a second offset latch circuit 136B, a digital-analog converter 137, and an output buffer 138.

The data controller 131 receives a data control signal DCS from the timing controller 140 and controls the level of a data output signal Sout which is supplied to the display panel 110 on the basis of the data control signal DCS.

The data driving circuit 130 generates an offset image data DATA(Offset) with an offset applied to the digital image data DATA which is transmitted from the timing controller 140, and supplies an offset data voltage Vdata(Offset) corresponding to the offset image data DATA(Offset) in an offset time Tos before the gate clock signal GCLK is enabled in the horizontal lines of the display panel 110, whereby it is possible to decrease the settling time TsetH or TsetL of the data voltage Vdata and the power consumption.

The data controller 131 stores the digital image data DATA received from the timing controller 140 and the offset image data DATA(Offset) with an offset value applied to the digital image data DATA together in the lookup table.

The data controller 131 transmits the digital image data DATA stored in the lookup table to the first latch circuit 135A and transmits the offset image data DATA(Offset) with an offset value applied thereto to the first offset latch circuit 135B.

The shift register 134 generates a first latch enable signal 1st LEN for operating the first latch circuit 135A and a first offset latch enable signal 1st LEN(Offset) for operating the first offset latch circuit 135B on the basis of a source sampling clock signal SCLK.

The first latch enable signal 1st LEN may control the timing at which the digital image data DATA which is transmitted from the first latch circuit 135A to the second latch circuit 136A is output to the display panel 110.

The first offset latch enable signal 1st LEN(Offset) may control the timing at which the offset image data DATA (Offset) which is transmitted from the first offset latch circuit 135B to the second offset latch circuit 136B is output to the display panel 110.

The first latch circuit 135A transmits the latched digital image data DATA to the second latch circuit 136A at a desired timing under the control of the first latch enable signal 1st LEN received from the shift register 134.

The first offset latch circuit 135B transmits the latched offset image data DATA(Offset) to the second offset latch circuit 136B at a desired timing under the control of the first offset latch enable signal 1st LEN(Offset) received from the shift register 134.

The second latch circuit 136A receives the digital image data DATA which is stored in the first latch circuit 135A and receives the offset image data DATA(Offset) which is stored in the first offset latch circuit 135B. In this case, the second latch circuit 136A is referred to as a second normal latch circuit.

The second latch circuit 136A receives a second latch enable signal 2nd LEN from the data controller 131 and transmits the digital image data DATA to the digital-analog converter 137.

The second offset latch circuit 136B receives a second offset latch enable signal 2nd LEN(Offset) from the data controller 131 and transmits the offset image data DATA (Offset) to the digital-analog converter 137.

The second offset latch enable signal 2nd LEN(Offset) may control the offset data voltage Vdata(Offset) to be output to the horizontal lines of the display panel 110 in a predetermined offset time Tos. The second latch enable signal 2nd LEN may control the data voltage Vdata corresponding to the digital image data DATA to be output when the offset time Tos in which the offset data voltage Vdata (Offset) is output has elapsed.

The digital-analog converter 137 converts the digital image data DATA or the offset image data DATA(Offset) transmitted to the digital-analog converter 137 to a gray-scale voltage Vgs using the gamma reference voltage Vgm received from the gamma reference voltage generating circuit 133.

The output buffer 138 includes a plurality of driving amplifiers and each driving amplifier outputs a data output signal Sout to the display panel 110 on the basis of the gray-scale voltage Vgs received from the digital-analog converter 137. The data output signal Sout includes the data voltage Vdata corresponding to the digital image data DATA or the offset data voltage Vdata(Offset) corresponding to the offset image data DATA(Offset).

Accordingly, the data output signal Sout which is applied to the display panel 110 via the output buffer 138 is the offset data voltage Vdata(Offset) with an offset applied thereto during a first offset time in a data enable section and is the data voltage Vdata without an offset applied thereto after the offset time has elapsed.

Accordingly, it is possible to decrease the settling time TsetH or TsetL of the data output signal Sout without increasing the bias set value which is applied to the data driving circuit 130 even when the time interval of the horizontal period is decreased due to fast drive thereof and thus to decrease the total power consumption by decreasing the constant current which is supplied to the driving amplifier Amp.

The above description merely provides some examples for describing the technical idea of the present disclosure, and various modifications and changes such as combination, separation, substitution, and alteration of configurations may be made by those skilled in the art without departing from the essential features of the disclosure. Accordingly, the embodiments of the present disclosure are not to restrict the technical idea of the disclosure but to explain the technical idea of the present disclosure. The technical idea of the present disclosure is not limited to the embodiments.

REFERENCE SIGNS LIST

100: Display device
110: Display panel
120: Gate driving circuit
130: Data driving circuit
131: Data controller
132: Bias voltage generating circuit
133: Gamma reference voltage generating circuit
134: Shift register
135A: First latch circuit
135B: First offset latch circuit
136, 136A: Second latch circuit
136B: Second offset latch circuit
137: Digital-analog converter
138: Output buffer
140: Timing controller The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel in which a plurality of subpixels are arranged at positions at which a plurality of data lines and a plurality of gate lines overlap with each other;

a gate driving circuit that drives the plurality of subpixels via the plurality of gate lines;

a data driving circuit that supplies a data output signal to the plurality of subpixels via the plurality of data lines, the data output signal including a data voltage and an offset data voltage which is generated by adding an offset to the data voltage; and a timing controller that controls the gate driving circuit and the data driving circuit, wherein the data driving circuit includes:

a data controller that generates offset image data by adding an offset to digital image data which is received from the timing controller;

a first latch circuit that stores the digital image data received from the data controller;

a first offset latch circuit that stores the offset image data received from the data controller;

a second latch circuit that stores the digital image data and the offset image data which are respectively transmitted from the first latch circuit and the first offset latch circuit;

a digital-analog converter that converts the digital image data and the offset image data transmitted from the second latch circuit to the data voltage and the offset data voltage; and an output buffer that supplies the data voltage and the offset data voltage to the display panel under the control of the data controller.

2. The display device according to claim 1, wherein the data controller includes a lookup table in which the digital image data and the offset image data are stored.

3. The display device according to claim 1, wherein the output buffer includes a driving amplifier that supplies the data voltage or the offset data voltage to the display panel based on a bias voltage.

4. The display device according to claim 1, wherein the offset is varied based on a gray scale of the digital image data.

5. The display device according to claim 1, wherein the offset is determined independently for each of a plurality of gray scales.

6. The display device according to claim 1, wherein the offset is determined by applying an interpolation method to gray scales of intermediate levels.

7. The display device according to claim 1, wherein the data controller controls the offset data voltage to be supplied to the display panel for an offset time in a data enable section.

8. The display device according to claim 7, wherein the offset time has an interval which is equal to or greater than a time from a start time point of the data enable section to a time point at which the offset data voltage reaches a stabilization level of the data voltage.

9. The display device according to claim 7, wherein the data controller controls the data voltage to be supplied to the display panel after the offset time has elapsed.

10. The display device according to claim 1, wherein the second latch circuit includes:

a second normal latch circuit that stores the digital image data which is transmitted from the first latch circuit; and a second offset latch circuit that stores the offset image data which is transmitted from the first offset latch circuit.

11. A data driving circuit, comprising:

a data controller that generates offset image data by adding an offset to digital image data which is received from a timing controller;

a first latch circuit that stores the digital image data received from the data controller;

a first offset latch circuit that stores the offset image data received from the data controller;

a second latch circuit that stores the digital image data and the offset image data which are respectively transmitted from the first latch circuit and the first offset latch circuit;

a digital-analog converter that converts the digital image data and the offset image data transmitted from the second latch circuit to a data voltage and an offset data voltage; and an output buffer that supplies the data voltage and the offset data voltage to a display panel under the control of the data controller.

12. The data driving circuit according to claim 11, wherein the data controller includes a lookup table in which the digital image data and the offset image data are stored.

13. The data driving circuit according to claim 11, wherein the output buffer includes a driving amplifier that supplies the data voltage or the offset data voltage to the display panel based on a bias voltage.

14. The data driving circuit according to claim 11, wherein the offset is varied based on a gray scale of the digital image data.

15. The data driving circuit according to claim 11, wherein the offset is determined by applying an interpolation method to gray scales of intermediate levels.

16. The data driving circuit according to claim 11, wherein the data controller controls the offset data voltage to be supplied to the display panel for an offset time in a data enable section.

17. The data driving circuit according to claim 16, wherein the offset time has an interval which is equal to or greater than a time from a start time point of the data enable section to a time point at which the offset data voltage reaches a stabilization level of the data voltage.

18. The data driving circuit according to claim 11, wherein the second latch circuit includes:

a second normal latch circuit that stores the digital image data which is transmitted from the first latch circuit; and a second offset latch circuit that stores the offset image data which is transmitted from the first offset latch circuit.

19. A data driving method comprising:

generating, by a data controller, offset image data by adding an offset to digital image data which is received from a timing controller;

storing, by a first latch circuit, the digital image data received from the data controller;

storing, by a first offset latch circuit, the offset image data received from the data controller;

storing, by a second latch circuit, the digital image data and the offset image data;

converting, by a digital-analog converter, the digital image data and the offset image data to a data voltage and an offset data voltage which are of an analog type; and supplying, by an output buffer, the data voltage and the offset data voltage to a display panel at different times.

20. The data driving method according to claim 19, wherein the offset data voltage is supplied to the display panel for an offset time in a data enable section.

21. The data driving method according to claim 20, wherein the offset time has an interval which is equal to or greater than a time from a start time point of the data enable section to a time point at which the offset data voltage reaches a stabilization level of the data voltage.

22. The data driving method according to claim 19, wherein the offset is varied based on a gray scale of the digital image data.

23. The data driving method according to claim 19, wherein the offset is determined by applying an interpolation method to gray scales of intermediate levels.

* * * * *